US006530708B2

(12) United States Patent
Ichikawa

(10) Patent No.: US 6,530,708 B2
(45) Date of Patent: Mar. 11, 2003

(54) INK FOLLOWER COMPOSITION FOR OIL-BASED BALLPOINT PENS

(75) Inventor: Shuuji Ichikawa, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/062,718

(22) Filed: Feb. 5, 2002

(65) Prior Publication Data

US 2002/0159821 A1 Oct. 31, 2002

(51) Int. Cl.[7] ..... B43K 7/08
(52) U.S. Cl. ..... 401/142; 401/141
(58) Field of Search ..... 401/142, 141, 401/221, 222, 188 A

(56) References Cited

U.S. PATENT DOCUMENTS

| | | | | |
|---|---|---|---|---|
| 5,348,989 A | | 9/1994 | Shiraishi | 523/161 |
| 6,012,864 A | * | 1/2000 | Asami | 401/142 |
| 6,200,053 B1 | * | 3/2001 | Asami et al. | 401/142 |
| 6,454,481 B1 | * | 9/2002 | Izumi | 401/142 |

FOREIGN PATENT DOCUMENTS

| | | |
|---|---|---|
| DE | 43 09 770 | 9/1993 |
| JP | 57-153070 | 9/1982 |
| JP | 57-200472 | 12/1982 |
| JP | 61-57673 | 3/1986 |
| JP | 61-145269 | 7/1986 |
| JP | 61-151289 | 7/1986 |
| JP | 61-200187 | 9/1986 |
| JP | 61-268786 | 11/1986 |
| JP | 62-50379 | 3/1987 |
| JP | 62-148581 | 7/1987 |
| JP | 5-270192 | 10/1993 |
| JP | 5-270193 | 10/1993 |

* cited by examiner

*Primary Examiner*—David J. Walczak
(74) *Attorney, Agent, or Firm*—Foley & Lardner

(57) ABSTRACT

An ink follower composition for oil-based ballpoint pens, comprising at least one organic solvent selected from the group consisting of a sparingly volatile organic solvent and a non-volatile organic solvent, a gelling agent comprising inorganic fine particles, and from 10 to 60% by weight of a resin soluble in the organic solvent used.

7 Claims, 1 Drawing Sheet

INK FOLLOWER COMPOSITION FOR OIL-BASED BALLPOINT PENS

BACKGROUND OF THE INVENTION

1. Field of the Invention

The present invention relates to an ink follower composition which is used at the rear end of ink in oil-based ballpoint pens which house the ink in an ink reservoir tube.

2. Description of Related Art

As for a gel-like ink follower, followers for use in aqueous ballpoint pens of a type where ink is directly housed in an ink reservoir tube have been heretofore disclosed in Japanese Unexamined Patent Publication (Kokai) Nos. 57-153070, 57-200472, 61-57673, 61-145269, 61-151289, 61-200187, 61-268786, 62-50379, 62-148581, 5-270192 and 5-270193. In the case of a ballpoint pen using an aqueous ink having low viscosity, these ink followers prevent the ink from leaking out when the pen tip is allowed to stand in the vertically upward or horizontal direction, and prevent the ink from splashing upon receipt of a light impact. Also, in the case of using an aqueous ink having high viscosity, when a mechanical impact is imposed or writing is performed while the pen tip is higher than the opposite end, the ink follower prevents the ink from entraining air and flowing out from the end of the ink reservoir tube (this is usually called "reverse flow") to soil human bodies, clothes and the like. In order to prevent this reverse flow, various ink reverse-flow inhibitors have been heretofore proposed.

On the other hand, the reverse-flow inhibitors for oil-based ballpoint pens include those where a plug for preventing the leakage of ink, using a sponge or plaster, is provided at the end of the ink reservoir tube of a ballpoint pen, and those where an ink follower capable of moving with the ink, along with the consumption of ink in the ink reservoir tube, is used at the ink end. The former case has a problem in that if the ink once contacts with the leakage-preventing plug, a vent hole provided in the plug is clogged and therefore, unless the plug is removed, the ballpoint pen cannot revert to its reusable state whatever method may be used. Even if the plug is removed to retrieve the reusable state, there arises a problem that when a reverse flow occurs, the ink leaks out from the back end.

In the latter case, some ink followers for oil-based ballpoint pens use a gelled grease, however, these are disadvantageous in that during storage at a high temperature or for a long period of time, the grease not only separates or becomes compatible with ink to cause deterioration in the quality, but it also becomes opaque and hardly distinguishable from ink to indicate to the user, when writing cannot be performed any more, that some ink remains. Moreover, when these ink followers are used as they are for oil-based ballpoint pens, the gelling agent transfers to the ink to cause oil separation and this gives rise to a failure in maintaining the effect as a reverse-flow inhibitor or, in many cases, to deterioration in the effect of the pen itself.

Oil-based ballpoint pens usually use a solvent having low vapor pressure and therefore, it is not necessary, in most cases, to provide an ink follower at the back end and thereby prevent the ink solvent from evaporating. However, in the case of an oil-based ballpoint pen using an ink containing a solvent having high vapor pressure, some countermeasure against the volatilization of the solvent is required. The simplest method for preventing the volatilization of solvent from the rear part of a refill or the like is to seal the rear part using a fixing member, however, this renders the pressure inside the refill or the like negative during writing and, as a result, writing cannot be performed.

As described above, the development of ink followers for oil-based ballpoint pens is accompanied by peculiar problems different from those in the case of an aqueous ballpoint pen. Accordingly, the ink follower for oil-based ballpoint pens must have all of the following qualities:

(1) to be stable without separating or becoming compatible with ink even after storage at a high temperature or for a long period of time;

(2) to have an improved resistance against a strong impact;

(3) to have appropriate follow-up performance to the ink;

(4) to be capable of shutting out the outside air from the ink and thereby preventing the volatilization of ink (this quality is important particularly in the case of an oil-based ballpoint pen using a quick drying ink obtained by incorporating a solvent having high vapor pressure into an ink);

(5) to have a capability of preventing leakage of ink from the back end of the ink reservoir tube after tip up writing; and (6) to not move to the distal end of the tip due to position to thereby cause reversal between the ink and the ink follower (occurrence of reversal phenomenon), even if there is a difference in the specific gravities.

The object of the present invention is to provide an ink follower composition which is an ink follower for oil-based ballpoint pens and has high suitability for inks enhanced in quick drying properties.

SUMMARY OF THE INVENTION

As a result of extensive investigations, the present inventors have found that the above-described problems can be overcome by an ink follower composition for oil-based ballpoint pens which is characterized by the following points. The present invention has been accomplished based on this finding.

More specifically, the present invention resides in the following matters (1) to (7).

(1) An ink follower composition for oil-based ballpoint pens, comprising at least one organic solvent selected from the group consisting of a sparingly volatile organic solvent and a non-volatile organic solvent, said solvent having an evaporation loss of 0.4% by weight or less under the conditions of 98° C. and 5 hours, a gelling agent comprising inorganic fine particles, and from 10 to 60% by weight of a resin soluble in the organic solvent used.

(2) The ink follower composition for oil-based ballpoint pens as described in (1) above, which is used for an oil-based ballpoint pen having housed therein an ink using an ink solvent containing from 10 to 100% by weight of a solvent selected from the group consisting of alcohols, glycols and glycol monoethers each having a vapor pressure of 0.01 to 50 mmHg at 25° C.

(3) The ink follower composition for oil-based ballpoint pens as described in (1) or (2) above, wherein the organic solvent is a liquid paraffin.

(4) The ink follower composition for oil-based ballpoint pens as described in any one of (1) to (3) above, wherein the resin is a resin insoluble in or forming a two phase region with a solvent having one or more hydroxyl groups within the molecular structure.

(5) The ink follower composition for oil-based ballpoint pens as described in any one of (1) to (3) above, wherein the resin contains at least one resin selected from the group consisting of terpene-base resins and phenol-base resins.

(6) The ink follower composition for oil-based ballpoint pens as described in any one of (1) to (5) above, wherein the inorganic fine particle is fine particulate silica.

(7) An oil-based ballpoint pen comprising an ink reservoir tube having housed therein:

(a) an ink containing at least a coloring material, a resin and a solvent, said solvent containing from 10 to 100% by weight of a solvent selected from the group consisting of alcohols, glycols and glycol monoethers each having a vapor pressure of 0.01 to 50 mmHg at 25° C., and (b) an ink follower composition containing at least one or more organic solvent selected from the group consisting of a sparingly volatile organic solvent and a non-volatile organic solvent, said solvent having an evaporation loss of 0.4% by weight or less under the conditions of 98° C. and 5 hours, a gelling agent comprising inorganic fine particles, and from 10 to 60% by weight of a resin which is soluble in the organic solvent used and is in a solid state at 25° C.

BRIEF DESCRIPTION OF THE DRAWING

In FIG. 1, the reference numeral 1 stands for a ballpoint pen tip, 5 a ballpoint pen microball, 6 a casing, and 7 a plug.

DETAILED DESCRIPTION OF THE INVENTION

Figure 1:
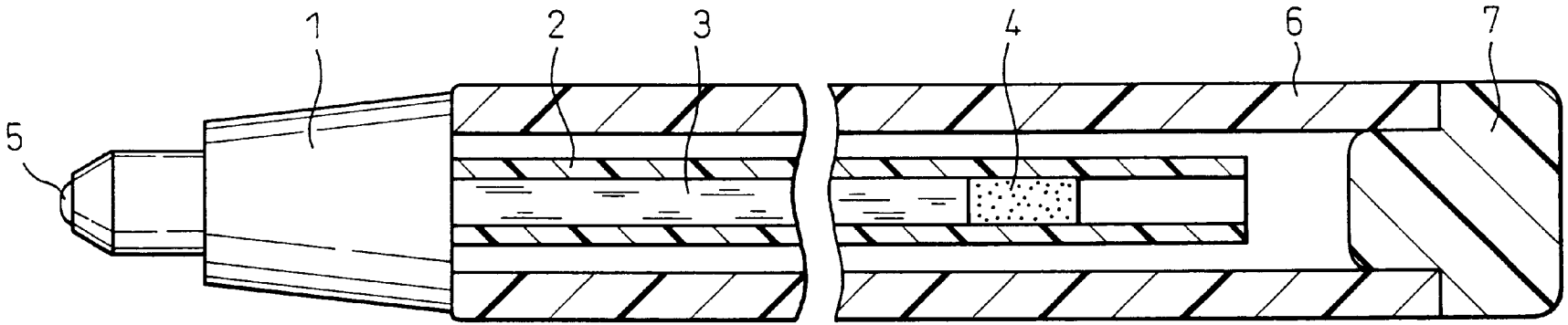
FIG. 1 shows a non-limiting example of an oil-based ballpoint pen comprising an ink reservor tube 2 in which an ink composition 3 and an ink follower 4 are housed.

The "sparingly volatile or non-volatile organic solvent" for use in the ink follower composition of the present invention indicates a solvent having the evaporation loss of 0.4% by weight (hereinafter simply referred to as "%") or less under the conditions of 98° C. and 5 hours and examples thereof include liquid paraffin, polybutene having an average molecular weight of 300 to 3,000, vaseline and spindle oil. Among these, liquid paraffin is preferred. These organic solvents can be used individually or in combination of two or more thereof. The organic solvent is used as a base oil of the follower and the content thereof is on the order of 39.5 to 84.5%, preferably from 40 to 70%, in the composition.

In the ink follower composition of the present invention, the inorganic fine particles used as a gelling agent are fine particles of a metal oxide or the like having a high specific surface area value (for example, approximately from 30 to 450 $m^2/g$) and representative examples thereof include fine particulate silica, fine particulate aluminum hydroxide, and fine particulate titanium. The inorganic fine particles such as fine particulate silica can be used irrespective of the presence or absence of the surface treatment or the method therefor insofar as they are very fine particles (for example, having an average primary particle size of approximately from 7 to 40 nm) having a high purity (for example, containing $SiO_2$ in excess of 99.9%). If desired, a thickener, a metal soap or the like can be used in combination with the silica.

For the organic fine particles, commercially available products may be used and specific examples thereof include Aerosil 50, Aerosil 90G, Aerosil 130, Aerosil 200, Aerosil 200V, Aerosil 200CF, Aerosil 200FAD, Aerosil 300, Aerosil 300CF, Aerosil 380 (these are hydrophilic silica), Aerosil R972, Aerosil R972V, Aerosil R972CF and Aerosil R974 (these are hydrophobic silica) produced by Aerosil Co., Ltd.; R202, R805, R812, R812S, OX50, TT600, MOX80, MOX170, COK84, RX200 and RY200 produced by Degsa Co., Ltd.; and Mizukasil Series produced by Mizusawa Industrial Chemicals, Ltd. Other than these, high-purity ultrafine particle-form aluminum oxide, high-purity ultrafine particle-form titanium dioxide and the like can also be used as the inorganic filler capable of exhibiting the same performance as the fine particulate silica.

The amount of the inorganic fine particles blended is preferably from 0.1 to 10%, more preferably from 0.5 to 6%, based on the composition. The gelling agent for use in the composition of the present invention is preferably fine particulate silica.

The resin for use in the ink follower composition of the present invention must be soluble in the sparingly volatile or non-volatile organic solvent used as the base oil, because the apparent ratio of the added gelling agent to the solvent can be increased by dissolving the resin.

In addition to this property, the resin is preferably in a solid state under the condition of 25° C., because the inorganic fine particle network formed by the gelling agent can be reinforced by the resin which is solid at room temperature, and thereby oil separation can be made more difficult.

Furthermore, the resin is preferably insoluble in or forming a two phase region with a solvent having one or more hydroxyl group within the molecular structure (for example, an alcohol, a glycol or a glycol monoether). Examples of this resin include rosin-modified phenol resin, rosin-modified maleic acid resin, terpene-base resin (for example, hydrogenated terpene) and phenol-base resin (preferably terpene-phenol resin). Among these, terpene-base resin and phenol-base resin are preferred.

In the composition, the resin is blended in an amount of 10 to 60%, preferably from 15 to 50%. The amount of the resin blended is from 10 to 60% because the resin is considered to play a part of dispersant, thickener, gelation reinforcing agent or the like for the inorganic fine particles as a gelling agent. If the amount blended is less than 10%, the effect of reinforcing the gelled state is low and oil separation readily occurs, whereas if it exceeds 60%, the resin may be disadvantageously decreased in the solubility, increased in the viscosity or intensified in the surface tackiness.

In addition to the above-described components, various surfactants can be added to the ink follower composition of the present invention. Examples of the surfactant include sparingly water-soluble polyoxyethylene and derivatives thereof, sparingly water-soluble polyoxypropylene and derivatives thereof, sparingly water-soluble polyglycerin and derivatives thereof, sparingly water-soluble sorbitan and derivatives thereof, sparingly water-soluble compounds having a perfluoroalkyl group, and sparingly water-soluble compounds having a polymethylsiloxane. In general, those capable of forming a nonionic surfactant having low HLB are preferred. Specific examples thereof include polyoxyethylene derivatives such as polyoxyethylene monoisostearate and polyoxyethylene castor oil, sorbitan derivatives such as sorbitan monostearate, polyglycerin derivatives such as hexaglycerin tetrastearate, fluorine-containing surfactants such as perfluoroalkyl ester of polyoxyethylene, and silicone-containing surfactants such as propylene oxide or ethylene oxide side chain adduct of methylpolysiloxane.

The ink follower composition of the present invention can further contain arbitrary components usable in the ink follower within the range of not impairing the effect of the present invention.

The ink follower composition of the present invention can be produced in the same manner as conventional ink followers and according to an ordinary method. For example, a sparingly volatile or non-volatile solvent (base oil) and components such as resin are stirred at room temperature and after these are dissolved, inorganic fine particles are added and kneaded with using a dispersing machine such as three-roll kneader, whereby a gel composition can be obtained.

The ink composition of an oil-based ballpoint pen using the ink follower composition of the present invention may contain, in addition to a normal ink for oil-based ballpoint pens, a quick drying ink in which the ink solvent contains from 10 to 100% of an intermediate polar solvent selected from the group consisting of alcohols, polyhydric alcohols and glycol monoethers each having a vapor pressure of 0.01 to 50 mmHg at 25° C. Even in the case of using such a quick drying ink in combination, the ink can be effectively prevented from permeation loss in weight or diffusion.

Examples of the alcohols as the ink solvent include ethanol, 1-propanol, 2-propanol, 1-butanol, 2-butanol, isobutyl alcohol, tert-butyl alcohol, 1-pentanol, 2-pentanol, 3-pentanol, iso-pentyl alcohol, tert-pentyl alcohol, 3-methyl-2-butanol, neopentyl alcohol, 1-hexanol, 2-methyl-1-pentanol, 4-methyl-2-pentanol, 2-ethyl-1-butanol, n-heptanol, 2-heptanol, 3-heptanol, benzyl alcohol and other various higher alcohols.

Examples of the polyhydric alcohols include glycols having two or more carbons and two or more hydroxyl groups within the molecule, such as ethylene glycol, diethylene glycol, 3-methyl-1,3-butanediol, triethylene glycol, propylene glycol, dipropylene glycol, 1,3-propanediol, 1,3-butanediol, 1,5-pentanediol, hexylene glycol and octylene glycol.

Examples of the glycol monoethers include ethylene glycol monomethyl ether, ethylene glycol monoethyl ether, ethylene glycol monopropyl ether, ethylene glycol monobutyl ether, ethylene glycol monophenyl ether, diethylene glycol monomethyl ether, diethylene glycol monoethyl ether, diethylene glycol monopropyl ether, diethylene glycol monobutyl ether, triethylene glycol monomethyl ether, triethylene glycol monoethyl ether, triethylene glycol monopropyl ether, triethylene glycol monobutyl ether, propylene glycol monomethyl ether, propylene glycol monoethyl ether, propylene glycol monopropyl ether, propylene glycol monobutyl ether, propylene glycol phenyl ether, propylene glycol tertiary butyl ether, dipropylene glycol monomethyl ether, dipropylene glycol monopropyl ether, dipropylene glycol monobutyl ether, tripropylene glycol monomethyl ether, tripropylene glycol monobutyl ether, 2-ethylhexyl ether, ethylene glycol monohexyl ether, ethylene glycol mono-2-ethylbutyl ether, 3-methoxybutanol and 3-methyl-3-methoxybutanol. Also, glycol monoesters can be used similarly to the glycol monoethers.

The ink follower of the present invention hardly allows permeation of the intermediate polar solvent described above and therefore, even in the case of using it in combination with a quick drying ink where the intermediate polar solvent occupies from 10 to 100% in the ink solvent, the solvent in the ink can be effectively prevented from volatilization and the sealing effect of the ink solvent can be maximally exerted.

In addition to the above-described solvent, the ink used together with the ink follower composition of the present invention can contain various auxiliary solvents in the range of 0 to 90%, such as sorbitan fatty acid-type, polyglycerin higher fatty acid-type, sucrose fatty acid-type and propylene glycol fatty acid-type derivatives, esters, glycol diethers and diesters of polyhydric alcohols.

In the present invention, the ink solvent and the ink follower solvent combined are preferably incompatible with each other. Examples of this combination include a combination such that the ink solvent is an intermediate polar solvent described above and the ink follower solvent is liquid paraffin.

The ink composition for oil-based ballpoint pens contains a coloring material and a resin in addition to the above-described solvent. The coloring material is prepared from a pigment, a dye or a combination thereof. The resin may be any resin insofar as is oil-based ballpoint pen performance and does not work out to a stable factor in the ink. According to the performance, various additives usable in inks can also be blended.

The viscosity of the ink is preferably 20 Pa·s or less, more preferably from 0.1 to 15 Pa·s, at a shear rate of $3.83/s^{-1}$.

The ink reservoir tube of a ballpoint pen using the ink follower of the present invention preferably has an inner diameter of 5 mm or less, more preferably 4 mm or less, by taking account of the ink-holding power of the capillary tube.

The ink follower composition of the present invention is optimally used in combination with an ink for oil-based ballpoint pens, however, may also be used in combination with other inks such as aqueous ink for aqueous ballpoint pens, which is directly housed in the ink reservoir tube.

In the ink follower of the present invention, unlike conventional ink followers, from 10 to 60% of a resin is dissolved in a sparingly volatile or non-volatile organic solvent as a substrate to increase the apparent ratio of the gelling agent to the solvent, whereby pseudoplasticity can be effectively imparted. In general, if the amount of organic fine particles added is increased until a desired static viscosity is obtained, the pseudoplasticity is impaired. However, in the present invention, a large amount of resin is added, so that an appropriate pseudoplasticity can be attained without increasing the amount of inorganic fine particles.

Also, by virtue of the addition of resin, the inorganic fine particles used as a gelling agent can be effectively dispersed. Furthermore, the addition of resin brings out the effects of reinforcing the gel structure and preventing the generation of oil separation with the passage of time.

EXAMPLES

The present invention is described in greater detail below by referring to Examples and Test Examples. However, the present invention is not limited thereto.

Ink (1) is used in the ink follower compositions of Examples 1 to 6 and Comparative Examples 1 to 5 and Ink (2) is used in the ink follower compositions of Examples 7 to 12. The resin used here is a terpene-base resin or a phenol-base resin.

<Ink (1)>

| | |
|---|---|
| VALIFAST Black #3830 [produced by Orient Chemical Industries, Ltd.] | 20% |
| Polyvinyl butyral BM-S [produced by Sekisui Chemical Co., Ltd.] | 10% |

-continued

| | |
|---|---|
| YP9OL [produced by Yasuhara Chemical Co., Ltd.] | 10% |
| Propylene glycol monomethyl ether | 20% |
| 3-Methoxy-butanol | 20% |
| 3-Methoxy-3-methyl-butanol | 20% |
| <Ink (2)> | |
| VALIFAST Black #3840 [produced by Orient Chemical Industries, Ltd.] | 30% |
| BECKASITE 1111 [produced by Dainippon Ink & Chemicals, Inc.] | 20% |
| Dipropylene glycol dimethyl ether | 40% |
| 3-Methoxy-3-methyl-butanol | 10% |
| (Example 1) | |
| Liquid paraffin MC Oil W-32 [produced by Idemitsu Petrochemical Co., Ltd.] | 65% |
| Aerosil R-972 [produced by Nippon Aerosil Co., Ltd.] | 5% |
| PX-1250 [terpene resin; produced by Yasuhara Chemical Co., Ltd.] | 30% |
| (Example 2) | |
| Liquid paraffin MC Oil W-8 [produced by Idemitsu Petrochemical Co., Ltd.] | 57% |
| Aerosil R-972 [produced by Nippon Aerosil Co., Ltd.] | 3% |
| Clearon P-125 [hydrogenated terpene; produced by Yasuhara Chemical Co., Ltd.] | 40% |
| (Example 3) | |
| Liquid paraffin MC Oil W-32 [produced by Idemitsu Petrochemical Co., Ltd.] | 58% |
| Aerosil R-972 [produced by Nippon Aerosil Co., Ltd.] | 2% |
| Clearon P-125 [hydrogenated terpene; produced by Yasuhara Chemical Co., Ltd.] | 40% |
| (Example 4) | |
| Liquid paraffin MC Oil W-32 [produced by Idemitsu Petrochemical Co., Ltd.] | 65% |
| Aerosil R-972 [produced by Nippon Aerosil Co., Ltd.] | 5% |
| K-110 [hydrogenated terpene; produced by Yasuhara Chemical Co., Ltd.] | 30% |
| (Example 5) | |
| Liquid paraffin MC Oil W-32 [produced by Idemitsu Petrochemical Co., Ltd.] | 67% |
| Aerosil R-972 [produced by Nippon Aerosil Co., Ltd.] | 3% |
| Clearon P-125 [hydrogenated terpene; produced by Yasuhara Chemical Co., Ltd.] | 30% |
| (Example 6) | |
| Liquid paraffin MC Oil W-8 [produced by Idemitsu Petrochemical Co., Ltd.] | 46.5% |
| Aerosil R-972 [produced by Nippon Aerosil Co., Ltd.] | 3% |
| Clearon P-125 [hydrogenated terpene; produced by Yasuhara Chemical Co., Ltd.] | 50% |
| Nonionic surfactant | 0.5% |
| (Comparative Example 1: not containing resin) | |
| Liquid paraffin MC Oil W-32 [produced by Idemitsu Petrochemical Co., Ltd.] | 97% |
| Aerosil R-972 [produced by Nippon Aerosil Co., Ltd.] | 3% |
| (Comparative Example 2: not containing gelling agent) | |
| Liquid paraffin MC Oil W-32 [produced by Idemitsu Petrochemical Co., Ltd.] | 85% |
| PX-1250 [terpene resin; produced by Yasuhara Chemical Co., Ltd.] | 15% |
| (Comparative Example 3: having a resin content of less than 10%) | |
| Liquid paraffin MC Oil W-32 [produced by Idemitsu Petrochemical Co., Ltd.] | 93% |

-continued

| | |
|---|---|
| Aerosil R-972 [produced by Nippon Aerosil Co., Ltd.] | 2% |
| Clearon P-125 [hydrogenated terpene; produced by Yasuhara Chemical Co., Ltd.] | 5% |
| (Comparative Example 4: having a resin content in excess of 60%) | |
| Liquid paraffin MC Oil W-32 [produced by Idemitsu Petrochemical Co., Ltd.] | 27% |
| Aerosil R-972 [produced by Nippon Aerosil Co., Ltd.] | 3% |
| Clearon P-125 [hydrogenated terpene; produced by Yasuhara Chemical Co., Ltd.] | 70% |
| (Comparative Example 5: where the ink follower resin was dissolved in the ink solvent) | |
| Liquid paraffin MC oil W-8 [produced by Idemitsu Petrochemical Co., Ltd.] | 78% |
| Aerosil R-972 [produced by Nippon Aerosil Co., Ltd.] | 2% |
| T-130 [terpene phenol resin; produced by Yasuhara Chemical Co., Ltd.] | 20% |
| (Example 7: where Ink (2) was used in the ink follower composition of Example 1) | |
| Liquid paraffin MC Oil W-32 [produced by Idemitsu Petrochemical Co., Ltd.] | 65% |
| Aerosil R-972 [produced by Nippon Aerosil Co., Ltd.] | 5% |
| PX-1250 [terpene resin; produced by Yasuhara Chemical Co., Ltd.] | 30% |
| (Example 8: where Ink (2) was used in the ink follower composition of Example 2) | |
| Liquid paraffin MC oil W-8 [produced by Idemitsu Petrochemical Co., Ltd.] | 57% |
| Aerosil R-972 [produced by Nippon Aerosil Co., Ltd.] | 3% |
| Clearon P-125 [hydrogenated terpene; produced by Yasuhara Chemical Co., Ltd.] | 40% |
| (Example 9: where Ink (2) was used in the ink follower composition of Example 3) | |
| Liquid paraffin MC Oil W-32 [produced by Idemitsu Petrochemical Co., Ltd.] | 58% |
| Aerosil R-972 [produced by Nippon Aerosil Co., Ltd.] | 2% |
| Clearon P-125 [hydrogenated terpene; produced by Yasuhara Chemical Co., Ltd.] | 40% |
| (Example 10: where Ink (2) was used in the ink follower composition of Example 4) | |
| Liquid paraffin MC Oil W-32 [produced by Idemitsu Petrochemical Co., Ltd.] | 65% |
| Aerosil R-972 [produced by Nippon Aerosil Co., Ltd.] | 5% |
| K-110 [hydrogenated terpene; produced by Yasuhara Chemical Co., Ltd.] | 30% |
| (Example 11: where Ink (2) was used in the ink follower composition of Example 5) | |
| Liquid paraffin MC Oil W-32 [produced by Idemitsu Petrochemical Co., Ltd.] | 67% |
| Aerosil R-972 [produced by Nippon Aerosil Co., Ltd.] | 3% |
| Clearon P-125 [hydrogenated terpene; produced by Yasuhara Chemical Co., Ltd.] | 30% |
| (Example 12: where Ink (2) was used in the ink follower composition of Example 6) | |
| Liquid paraffin MC Oil W-8 [produced by Idemitsu Petrochemical Co., Ltd.] | 46.5% |
| Aerosil R-972 [produced by Nippon Aerosil Co., Ltd.] | 3% |
| Clearon P-125 [hydrogenated terpene; produced by Yasuhara Chemical Co., Ltd.] | 50% |
| Nonionic surfactant | 0.5% |

The components according to the above-described blending were stirred by a disperser and kneaded by a roll mill to obtain ink followers. The obtained ink followers were then evaluated by the following evaluation tests. The results are shown in Table 1.

For filling each ink follower, a centrifugal separator Model H-103N manufactured by Kokusan Enshinki Co., Ltd. was used and a centrifugal force was applied at 3,000 rpm for 5 minutes in the direction from the rear end of the pen to the pen tip. The ballpoint pen used in the tests had a polypropylene tube and a stainless steel tip (the ball was made of a sintered hard alloy tungsten carbide and had a diameter of 1.4 mm).

TABLE 1

| | Examples | | | | | | | | | | | | Comparative Examples | | | | |
|---|---|---|---|---|---|---|---|---|---|---|---|---|---|---|---|---|---|
| Evaluation Tests | 1 | 2 | 3 | 4 | 5 | 6 | 7 | 8 | 9 | 10 | 11 | 12 | 1 | 2 | 3 | 4 | 5 |
| Reversal when Tip was Laid Upward | ○ | ○ | ○ | ○ | ○ | ○ | ○ | ○ | ○ | ○ | ○ | ○ | Δ | x | ○ | — | ○ |
| Follow-up to Ink | ○ | ○ | ○ | ○ | ○ | ○ | ○ | ○ | ○ | ○ | ○ | ○ | ○ | ○ | ○ | — | ○ |
| Permeation Loss in Weight | 10% or less | 10% or less | 10% or less | 10% or less | 10% or less | 10% or less | — | — | — | — | — | — | 10% or less | 10% or less | 10% or less | — | 10% or less |
| Diffusibility | ○ | ○ | ○ | ○ | ○ | ○ | — | — | — | — | — | — | Δ | Δ | Δ | — | Δ |
| Storage Stability | ○ | ○ | ○ | ○ | ○ | ○ | ○ | ○ | ○ | ○ | ○ | ○ | x | ○ | x | — | ○ |
| Prevention of Drop Leakage | 10 | 10 | 10 | 10 | 10 | 10 | 10 | 10 | 10 | 10 | 10 | 10 | 8 | 0 | 8 | — | 10 |

Note:
In Comparative Example 4, the composition could not be prepared as an ink follower.

<Evaluation Tests>

1. Reversal When Tip was Up

The presence or absence of reversal between the ink and the ink follower was observed while leaving the tip up at room temperature for 2 weeks.

<Evaluation>

| | |
|---|---|
| Not reversed: | ⊙ |
| The distal end of refill was slightly transparent: | Δ |
| Almost reversed or almost flowed out: | x |

2. Follow-Up to Ink

Free-hand writing (circle writing) was performed on paper (PPC) and the degree of thinning was observed.

<Evaluation>

| | |
|---|---|
| Almost no thinning: | ⊙ |
| Slight thinning: | Δ |
| Serious thinning: | x |

3. Permeation Loss in Weight

Into a (cylindrical) glass tube having an inner diameter of 8 mmϕ, 5.5 g of the ink was charged and 1 g of the ink follower was filled. These were lightly centrifuged and after passage of one month at a temperature of 50° C. and a humidity of 30%, the permeation loss in weight of ink was measured.

4. Diffusibility

After the test of the permeation loss in weight was finished, the state at the interface between the ink and the ink follower was observed.

<Evaluation>

| | |
|---|---|
| Distinct interface: | ⊙ |
| Ambiguous boundary of the interface: | Δ |
| Very ambiguous boundary of the interface: | x |

5. Storage Stability

Into a glass bottle, 20 g of the ink follower composition was charged and then the bottle was tightly stopped. After allowing it to stand at a temperature of 50° C. for 2 weeks, the presence or absence of oil separation was observed.

| | |
|---|---|
| No oil separation: | ⊙ |
| Slight oil separation: | Δ |
| Serious oil separation: | x |

<Evaluation>

6. Prevention of Drop Leakage

Ten pen bodies were dropped from the height of 1.5 m on the concrete to land from the rear end side and the number of pens which underwent no leakage of ink was counted.

It was revealed from the results shown above that the ink follower compositions for oil-based ballpoint pens of Examples 1 to 12, which are within the scope of the present invention, are very excellent in the follow-up to ink, the storage stability and the prevention of drop leakage, and also prevented the permeation loss in weight, diffusibility and reversal when the tip is up, as compared with the ink followers for oil-based ballpoint pens of Comparative Examples 1 to 5, which are out of the scope of the present invention.

EFFECTS OF THE INVENTION

The ink follower composition for oil-based ballpoint pens of the present invention prevented the permeation loss in weight of solvent, the diffusibility and the reversal phenomenon when the tip is up, and exerts very excellent performance in view of storage stability and prevention of drop leakage and, needless to say, the follow-up of ink. In particular, this is a transparent ink follower composition having high suitability for quick drying ink for oil-based ballpoint pens, being stable even in storage at a high temperature or for a long period of time, and even if a reverse flow occurs, it is able to recover the reusable state while maintaining the initial quality, to a certain extent.

What is claimed is:

1. An ink follower composition for oil-based ballpoint pens, comprising at least one organic solvent selected from the group consisting of a sparingly volatile organic solvent and a non-volatile organic solvent, said solvent having an evaporation loss of 0.4% by weight or less under the conditions of 98° C. and 5 hours, a gelling agent comprising inorganic fine particles, and from 10 to 60% by weight of a resin soluble in the organic solvent used.

2. The ink follower composition for oil-based ballpoint pens as claimed in claim 1, which is used for an oil-based ballpoint pen having housed therein an ink using an ink solvent containing from 10 to 100% by weight of a solvent selected from the group consisting of alcohols, glycols and glycol monoethers each having a vapor pressure of 0.01 to 50 mmHg at 25° C.

3. The ink follower composition for oil-based ballpoint pens as claimed in claim 1, wherein the organic solvent is a liquid paraffin.

4. The ink follower composition for oil-based ballpoint pens as claimed in claim 1, wherein the resin is a resin insoluble in or forming a two phase region with a solvent having one or more hydroxyl groups within the molecular structure.

5. The ink follower composition for oil-based ballpoint pens as claimed in claim 1, wherein the resin contains at least one resin selected from the group consisting of terpene-base resins and phenol-base resins.

6. The ink follower composition for oil-based ballpoint pens as claimed in claim 1, wherein the inorganic fine particles are fine particulate silica.

7. An oil-based ballpoint pen comprising an ink reservoir tube having housed therein:

(a) an ink containing at least a coloring material, a resin and a solvent, said solvent containing from 10 to 100% by weight of a solvent selected from the group consisting of alcohols, glycols and glycol monoethers each having a vapor pressure of 0.01 to 50 mmHg at 25° C., and (b) an ink follower composition containing at least one or more organic solvents selected from the group consisting of a sparingly volatile organic solvent and a non-volatile organic solvent, said solvent having an evaporation loss of 0.4% by weight or less under the conditions of 98° C. and 5 hours, a gelling agent comprising inorganic fine particles, and from 10 to 60% by weight of a resin which is soluble in the organic solvent used and is in a solid state at 25° C.

* * * * *